US008046885B1

(12) United States Patent
Massotte

(10) Patent No.: US 8,046,885 B1
(45) Date of Patent: Nov. 1, 2011

(54) APPARATUS AND METHODS FOR CRIMPING TEXTILE THREADS

(75) Inventor: Philippe Massotte, Gueberschwihr (FR)

(73) Assignee: Superba (FR)

( * ) Notice: Subject to any disclaimer, the term of this patent is extended or adjusted under 35 U.S.C. 154(b) by 572 days.

(21) Appl. No.: 12/131,189

(22) Filed: Jun. 2, 2008

(51) Int. Cl.
*D02G 1/12* (2006.01)

(52) U.S. Cl. ..... 28/269; 28/263

(58) Field of Classification Search ..... 28/263, 28/268, 269, 270, 247, 250, 251, 258, 265, 28/212, 262, 252, 253, 264; 26/99, 101, 26/102, 104, 105, 97, 98; 492/27, 28, 30, 492/33, 36; 264/168, 280, 282; 74/813 R; 162/282, 280; 226/181, 182, 183, 190
See application file for complete search history.

(56) References Cited

U.S. PATENT DOCUMENTS

| | | | | | |
|---|---|---|---|---|---|
| 497,912 | A * | 5/1893 | Dodd | 19/258 |
| 634,307 | A * | 10/1899 | Neidhardt | 26/106 |
| 679,425 | A * | 7/1901 | Kertesz | 68/9 |
| 2,187,567 | A * | 1/1940 | Esselmann et al. | 28/269 |
| 2,793,418 | A * | 5/1957 | Pfau | 28/265 |
| 2,820,278 | A * | 1/1958 | Munch et al. | 28/269 |
| 3,156,016 | A * | 11/1964 | Dunlap et al. | 19/66 T |
| 3,255,507 | A * | 6/1966 | McCaskill | 28/269 |
| 3,263,298 | A * | 8/1966 | Holton | 28/218 |
| 3,353,239 | A * | 11/1967 | Heijnis | 28/258 |
| 3,386,142 | A * | 6/1968 | Stanley et al. | 28/265 |
| 3,387,349 | A * | 6/1968 | Trifunovic et al. | 28/258 |
| 3,416,772 | A * | 12/1968 | Sheehan | 225/3 |
| 3,479,710 | A * | 11/1969 | Turton et al. | 28/252 |
| 3,529,045 | A * | 9/1970 | Rosenstein | 264/40.6 |
| 3,588,978 | A * | 6/1971 | Brafford | 492/33 |
| 3,651,630 | A * | 3/1972 | Gemeinhardt | 57/351 |
| 3,672,013 | A * | 6/1972 | Vernon et al. | 28/246 |
| 3,725,985 | A * | 4/1973 | Yarber | 28/279 |
| 4,301,579 | A * | 11/1981 | Van den Hoven | 28/282 |
| 4,558,725 | A * | 12/1985 | Veneziale | 144/362 |
| 4,796,680 | A * | 1/1989 | Koba | 144/2.1 |
| 5,074,016 | A | 12/1991 | Meyer | |
| 5,319,831 | A * | 6/1994 | Takehara | 28/263 |
| 5,455,992 | A * | 10/1995 | Kurschatke et al. | 26/99 |
| 5,507,226 | A * | 4/1996 | Burke et al. | 101/228 |
| 6,079,087 | A * | 6/2000 | Cansler | 28/279 |
| 7,325,284 | B2 * | 2/2008 | Lane et al. | 28/269 |
| 2005/0283958 | A1 * | 12/2005 | Sanderson et al. | 28/263 |

* cited by examiner

*Primary Examiner* — Amy Vanatta
(74) *Attorney, Agent, or Firm* — Dean W. Russell; Kilpatrick Townsend & Stockton LLP

(57) ABSTRACT

Thread-crimping machines with enhanced throughput are detailed. One or more drive rolls forming parts of the machines may be grooved to group centrally the entering threads without materially adversely impacting driving and crimping operations of the machines. Thread-focusing components also may be employed upstream of the inlet areas.

15 Claims, 3 Drawing Sheets

APPARATUS AND METHODS FOR CRIMPING TEXTILE THREADS

FIELD OF THE INVENTION

This invention relates to machines and techniques for crimping textile threads and more particularly, although not necessarily exclusively, to such machines and techniques providing increased throughput while maintaining regularity of crimping.

BACKGROUND OF THE INVENTION

Commonly-owned U.S. Pat. No. 5,074,016 to Meyer details a widely-used machine, known as a "stuffer box," for crimping textile threads. Described as part of the machine are a compression chamber, a decompression chamber, and pivoting paddles defining an evacuation, or holding, chamber. Spring blocks or similar structures may bias the paddles to a normally-closed position, initially closing the outlet.

Textile thread introduced into the machine via drive pulleys (e.g. nip rolls) packs into the compression chamber, with the act of compression facilitating crimping of the threads. Additional thread forced into the machine drives crimped thread from the compression chamber into the decompression chamber, where the crimped thread is subjected to an atmosphere of hot steam (or other appropriate fluid). Subjecting the thread to vapor in this manner assists in fixing the crimps in the thread.

Thereafter, the fixed, crimped thread is forced into the evacuation chamber. Doing so counteracts force provided by the spring blocks so that the paddles open slightly. As the paddles open, thread may exit the machine for further processing or to be wound onto a winding machine or other device.

Machines detailed in the Meyer patent function well in use. Desirably, however, these machines could provide increased throughput of crimped threads. One possible way of increasing throughput is to increase the height of the machine, thereby increasing the volumes of the compression, decompression, and evacuation chambers. Increasing the volumes of the chambers obviously increases the amount of thread positionable in each chamber. Unfortunately, however, it also decreases the uniformity of the crimping, an undesirable result.

Another possible technique for increasing throughput is to expand the width of the machine. Enlarging the width of the stuffer box allows for relatively uniform crimping of the threads, thus avoiding the problem associated with increasing the height of the machine. Regrettably, though, a width increase mandates a corresponding resizing of the nip rolls. Such resizing exacerbates the ability of one thread to slide relative to another, producing different entry speeds of threads into the stuffer box. The different entry speeds in turn create exit difficulties associated with the threads and their subsequent winding.

SUMMARY OF THE INVENTION

The present invention provides an alternate manner of increasing throughput of machines such as (but not limited to) that of the Meyer patent. Rather than increasing the height or width of the stuffer box, the present invention reconfigures the nip rolls so as to group the threads in one (preferably central) region of the roll faces. This grouping reduces tendency of the threads to spread across the faces and slide relative to each other—or off the faces entirely—promoting uniformity of entry speed and correspondingly increasing throughput.

A presently-preferred version of the invention incorporates a circumferential groove in a central region of the face of at least one nip roll. The groove beneficially is concave in shape, although it need not necessarily be so. An eyelet or other thread-focusing means optionally may be provided upstream of the nip rolls. If such an eyelet is utilized, it preferably will have diameter less than or equal to the width of the groove.

It thus is an optional, non-exclusive object of the present invention to provide improved apparatus and methods for crimping textile threads.

It also is an optional, non-exclusive object of the present invention to provide crimping machines configured to allow greater thread throughput than generally commercially available.

It is another optional, non-exclusive object of the present invention to provide greater thread throughput without changing the height or width of the stuffer box.

It is a further optional, non-exclusive object of the present invention to provide machines in which at least one nip roll is grooved to group threads entering the machines.

It is, moreover, an optional, non-exclusive object of the present invention to provide an eyelet upstream of the grooved roll (or rolls) to condense the threads into the region defined by the groove (or grooves).

Other objects, features, and advantages of the present invention will be apparent to those skilled in the appropriate field with reference to the remaining text and drawings of this application.

DETAILED DESCRIPTION

Figure 1:
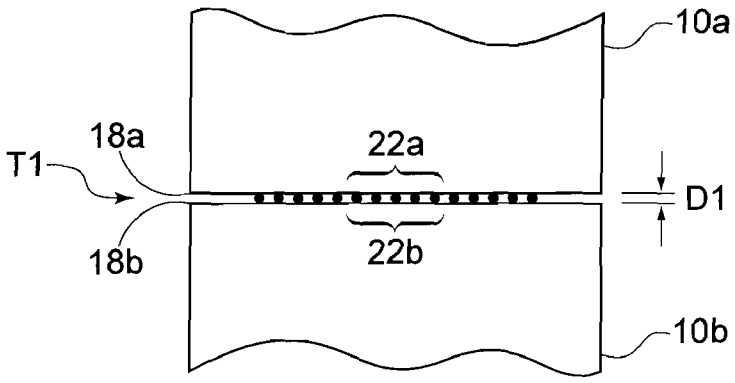
FIG. 1 is a schematicized view of a pair of nip rolls as conventionally configured as part of a textile thread-crimping machine.

Illustrated in FIGS. 1-4 is a pair of drive pulleys, preferably in the form of nip rolls 10A-B, for a stuffer box or other crimping machine 14. As detailed in the Meyer patent, rolls 10A-B introduce thread into machine 14 to commence the crimping operation. In particular, respective drive faces 18A-B of rolls 10A-B are spaced slightly (by a small distance D1 in FIG. 1), creating an area in which the thread may be positioned. Generally, positioning the thread in the central regions 22A-B of faces 18A-B (i.e. remote from edges 26A-B and 30A-B) produces greater regularity of crimping, both by centering the thread for entry into compression chamber 34 and by reducing likelihood of the thread sliding from between rolls 10A-B and thereby losing its drive force. FIG. 1 shows a conventional mass of thread T1 entering machine 14 when rolls 10A-B are spaced by distance D1.

Figure 2:
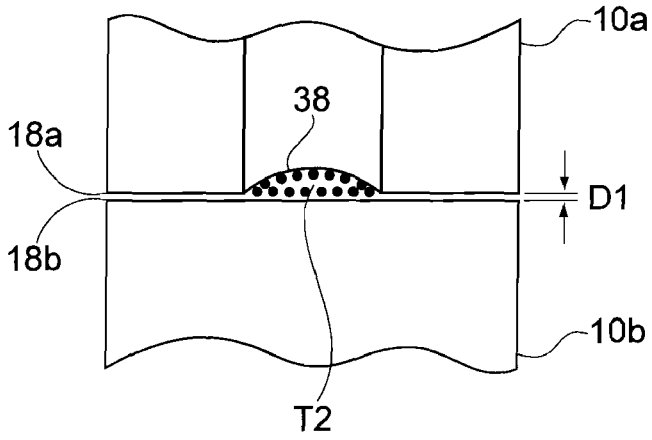
FIG. 2 is a schematicized view of the nip rolls of FIG. 1 as modified consistent with the present invention.

FIG. 2, by contrast, illustrates a centrally-grouped (and probably larger) mass of thread T2 entering machine 14 notwithstanding maintenance of the minimum spacing of drive faces 18A-B at distance D1. This result may be achieved by creating (circumferential) groove 38 in central region 22A of drive face 18A of roll 10A. Thread may fill groove 38 during operation of machine 14, allowing a more centrally-bunched grouping of thread to enter machine 14 at all times. In effect, creation of groove 38 both centers thread T2 for entry into machine 14 and reduces likelihood of the thread T2 sliding from between rolls 10A-B or relative to each other. Rolls 10A-B retain their ability to drive thread T2 into machine 14, however, so no material sacrifice of performance occurs. Consequently, use of groove 38 may increase throughput of machine 14 without adverse results.

Figure 3:
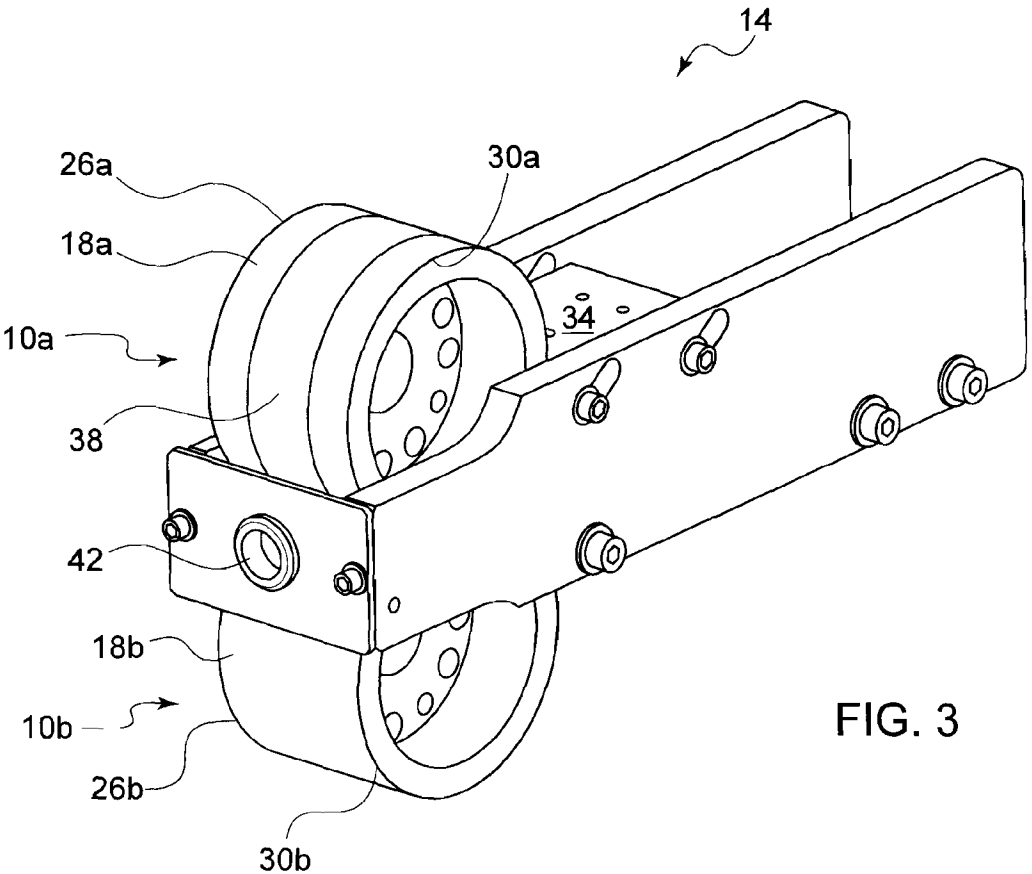
FIG. 3 is a perspective view of a portion of a crimping machine incorporating the nip rolls of FIG. 2.
Figure 4:
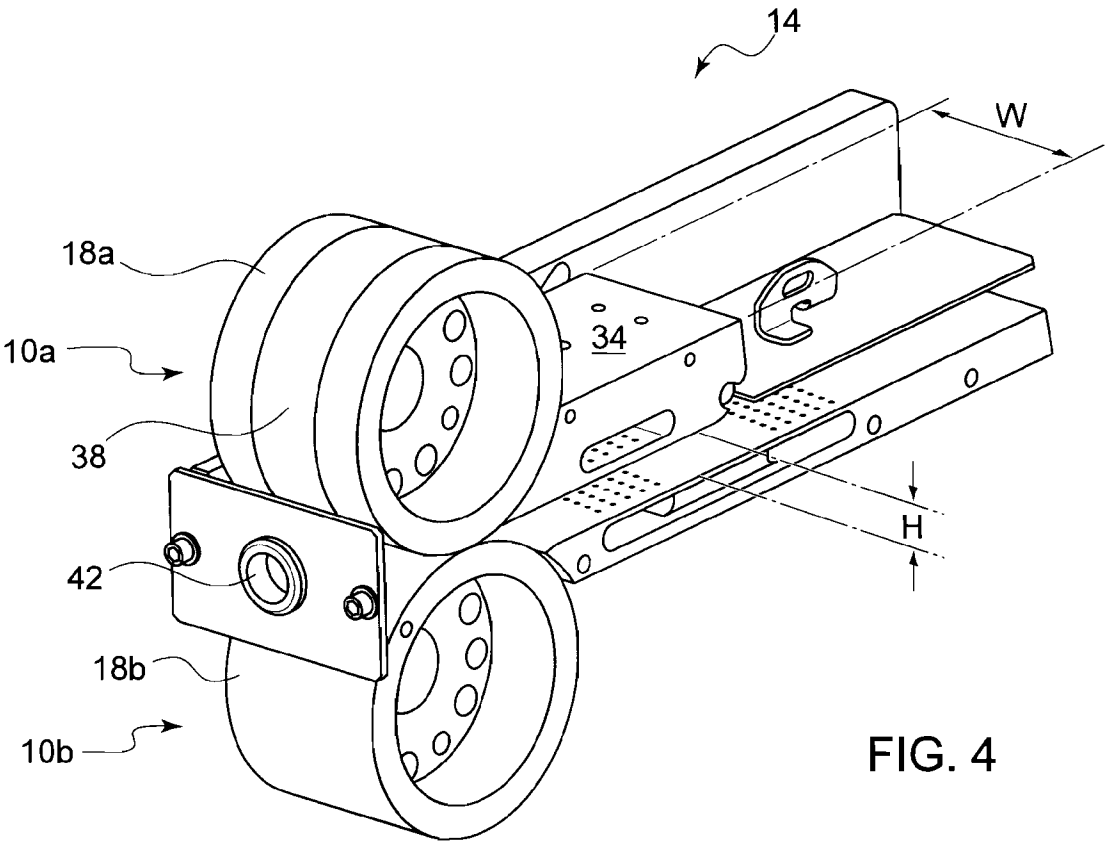
FIG. 4 is a perspective view of the interior of part of the crimping machine shown in FIG. 3.

As shown in FIG. 2, groove 38 is semi-circular or otherwise concave in shape. Groove 38 need not necessarily be concave, however, but rather may have any shape desired or suitable for its intended purposes. Further, although only one groove 38 is depicted in FIGS. 2-4, more than one groove may be utilized consistent with the present invention. For example, central region 22B of drive face 18B likewise could be grooved, or either of drive faces 18A or 18B could have multiple grooves 38. However, because incorporating multiple grooves 38 into a single drive face 18A or 18B might create multi-modal crimping characteristics, doing so is not presently preferred.

Also depicted in FIGS. 3-4 is optional eyelet 42. If present, eyelet 42 preferably is located upstream of rolls 10A-B, so that thread encounters it before encountering the rolls 10A-B. Consequently, eyelet 42 may function to consolidate, or focus, the thread toward central areas 22A-B of drive faces 18A-B. The diameter of eyelet 42 preferably is equal to or less than the width of groove 38. Eyelet 42 need not necessarily be so sized, however, and may if desired be shaped differently than as shown in FIGS. 3-4.

The foregoing is provided for purposes of illustrating, explaining, and describing embodiments of the present invention. Modifications and adaptations to these embodiments will be apparent to those skilled in the art and may be made without departing from the scope or spirit of the invention. The contents of the Meyer patent are incorporated herein in their entirety by this reference.

What is claimed is:

1. A thread-crimping machine comprising:

a. a first drive roll (i) configured for rotation about an axis and (ii) having means for defining a thread entrance into the machine, the thread entrance-defining means comprising a circumferentially grooved drive face oriented perpendicular to the axis; and b. a second drive roll (i) paired with the first drive roll and (ii) having an ungrooved drive face.

2. A machine according to claim 1 in which the groove in the drive face is concave.

3. A machine according to claim 1 further comprising an eyelet.

4. A machine according to claim 3 in which the thread encounters the eyelet before encountering the entrance.

5. A machine according to claim 1 in which the grooved drive face has opposed edges and a central region therebetween, the groove being located in the central region.

6. A machine according to claim 1 in which the grooved drive face contains only one circumferential groove.

7. A machine according to claim 6 in which the grooved drive face has opposed edges and a central region therebetween, the only one circumferential groove being located in the central region.

8. A machine according to claim 6 in which the only one circumferential groove is concave.

9. A thread-crimping machine comprising:

a. a drive roll defining an entrance for thread into the machine and having a circumferentially grooved drive face; and b. an eyelet; and in which (a) the groove in the drive face has a width, (b) the eyelet has a diameter equal to or less than the width of the groove, and (c) the thread encounters the eyelet before encountering the entrance.

10. A machine according to claim 9 further comprising a second drive roll having an ungrooved drive face.

11. A machine according to claim 9 further comprising a second drive roll having a circumferentially grooved drive face.

12. A textile thread-crimping machine comprising:

a. a chamber into which textile thread may enter;

b. means for driving the textile thread into the chamber, the driving means comprising paired first and second rolls, the first roll configured for rotation about an axis and having a centrally circumferentially grooved drive face (i) oriented perpendicular to the axis and (ii) receiving the textile thread in the groove and the second roll having an ungrooved drive face; and c. means, positioned upstream of the driving means and having diameter equal to or less than the width of the groove, for focusing the textile thread toward the groove of the drive face.

13. A method of crimping thread comprising:

a. providing paired first and second drive rolls for the thread, the first drive roll (i) configured for rotation about an axis and (ii) having a drive face having a circumferential groove therein perpendicular to the axis and the second drive roll having an ungrooved drive face;

b. passing the thread through the groove; and c. crimping the thread.

14. A method according to claim 13 further comprising:

a. providing an eyelet; and b. passing the thread through the eyelet.

15. A method according to claim 14 in which the thread passes through the eyelet before passing through the groove.

* * * * *